US005823728A

United States Patent [19]

Veldman et al.

[11] Patent Number: 5,823,728

[45] **Date of Patent: *Oct. 20, 1998**

[54] SEGMENTED RESIDENTIAL FRONT LOADING REFUSE COLLECTION VEHICLE

[75] Inventors: Russell Veldman, Villa Park; Thomas A. Becvar, Lombard, both of Ill.

[73] Assignee: Toccoa Metal Technologies, Inc., Toccoa, Ga.

[ * ] Notice: This patent issued on a continued prosecution application filed under 37 CFR 1.53(d), and is subject to the twenty year patent term provisions of 35 U.S.C. 154(a)(2).

[21] Appl. No.: 599,789

[22] Filed: Feb. 12, 1996

[51] Int. Cl.[6] ..... B65F 3/20

[52] U.S. Cl. ..... 414/510; 414/517; 414/525.6

[58] Field of Search ..... 414/510–513, 414/516–517, 525.2, 525.6, 406; 220/909; 296/24.1; 52/71

[56] References Cited

U.S. PATENT DOCUMENTS

| | | | |
|---|---|---|---|
| 2,914,205 | 11/1959 | Trubinski . | |
| 3,709,388 | 1/1973 | Neufeldt . | |
| 3,901,394 | 8/1975 | Bowles | 414/511 |
| 4,013,181 | 3/1977 | Johnson . | |
| 4,096,956 | 6/1978 | Gaskin . | |
| 4,111,485 | 9/1978 | Martin et al. | 414/510 X |
| 4,113,125 | 9/1978 | Schiller . | |
| 4,260,317 | 4/1981 | Martin et al. | 414/517 |
| 4,372,726 | 2/1983 | Lutz | 414/517 |
| 4,425,070 | 1/1984 | Howells et al. | 414/498 |
| 4,865,227 | 9/1989 | Stephens | 222/135 |
| 4,954,040 | 9/1990 | Smith et al. | 414/525.3 |
| 5,035,563 | 7/1991 | Mezey | 414/409 |
| 5,035,564 | 7/1991 | Matsumoto | 414/409 |
| 5,071,307 | 12/1991 | Carson | 414/408 |
| 5,074,737 | 12/1991 | Pellegrini et al. | 414/406 |
| 5,078,567 | 1/1992 | Lombardo | 414/525.6 |
| 5,094,582 | 3/1992 | Molzhon | 414/406 |
| 5,116,184 | 5/1992 | Pellegrini et al. | 414/406 |
| 5,122,025 | 6/1992 | Glomski | 414/486 |
| 5,205,698 | 4/1993 | Mezey | 414/406 |
| 5,222,853 | 6/1993 | Carson | 414/408 |
| 5,288,196 | 2/1994 | Horning et al. | 414/407 |
| 5,314,290 | 5/1994 | Lutz et al. | 414/517 X |
| 5,316,430 | 5/1994 | Horning et al. | 414/407 |
| 5,344,273 | 9/1994 | Radlein | 414/409 |
| 5,458,452 | 10/1995 | Pellegrini | 414/406 |

FOREIGN PATENT DOCUMENTS

| | | | |
|---|---|---|---|
| 314-238 | 5/1989 | European Pat. Off. . | |
| 3537546 | 4/1987 | Germany . | |
| 4024568 | 2/1992 | Germany | 414/512 |
| 9315982 | 8/1993 | WIPO | 414/408 |
| 9405568 | 3/1994 | WIPO | 414/408 |
| 9405570 | 3/1994 | WIPO | 414/512 |
| 94/07774 | 4/1994 | WIPO | 414/406 |

*Primary Examiner*—James W. Keenan
*Attorney, Agent, or Firm*—Kennedy,Davis & Kennedy, P.C.

[57] ABSTRACT

A segmented residential front loading refuse collection vehicle for collecting recyclable waste materials includes a frame and bed pivotally mounted on the frame, the bed having a front, a rear, a top, and a bottom. A fixed wall extends vertically from the bed bottom toward the bed top and extends longitudinally from the bed rear toward the bed front. A movable wall cooperates with the fixed wall for dividing the bed into side-by-side compartments. A single compactor blade is positioned partially within each of the side-by-side compartments for compacting the compartments in tandem.

16 Claims, 4 Drawing Sheets

10
11
12
13
14
16
17
21
22
23
26
27
28
31
32
33
34
36
51
76
77
83
91
96

SEGMENTED RESIDENTIAL FRONT LOADING REFUSE COLLECTION VEHICLE

TECHNICAL FIELD

The present invention relates generally to refuse collection vehicles, and more particularly relates to front loading refuse collection vehicles of the type particularly adapted for residential collection of recyclable and/or non-recyclable waste materials.

BACKGROUND OF THE INVENTION

Front loading refuse collection vehicles are generally known. Typically, such vehicles have been used in the past in commercial applications for lifting and dumping commercial waste containers. These vehicles include a pair of lifting arms with a corresponding pair of forks for engaging channels in the sides or bottom of the containers to facilitate lifting the containers for dumping them into the vehicle body.

Unlike commercial refuse collection vehicles, residential refuse collection vehicles have typically been loaded from the rear. Such a rear-loading vehicle is shown in U.S. Pat. No. 4,527,656 to Walbridge. A disadvantage of rear-loading arrangements is that the driver's compartment of the vehicle is a good distance from the rear of the vehicle where the loading takes place, requiring excessive walking to and fro by the operator if a single operator is used. Of course, if a second operator is used (one for driving and one for loading) additional cost is incurred.

In the collection of recyclable waste materials from residences, it has been found in the art that a single compartment in the truck bed is inadequate for handling the different materials. Thus, the use of multiple compartments in the truck bed for collecting and transporting separated recyclable waste products has become known. For example, U.S. Pat. No. 5,035,564 of Matsumoto '564 discloses a truck body construction for separate handling of recycling refuse. Matsumoto '564 discloses a side loading vehicle having side-by-side longitudinal compartments. Also, U.S. Pat. No. 5,074,737 of Pelligrini, et al. relates to a trash collection vehicle having multiple compartments, with each compartment having its own compacting blade for compacting recyclable waste material in the compartment.

U.S. Pat. No. 5,116,184 of Pelligrini discloses a vehicle and method for collecting recyclable waste materials with a front loading arrangement. In the Pelligrini '184 patent, side-by-side arrangement of longitudinal compartments is described.

U.S. Pat. No. 5,316,430 of Horning, et al. relates to a side loading material collecting and hauling apparatus having front and rear compartments. In Horning, an adjustable divider wall is provided for adjusting the relative volumes of the two compartments.

Despite these developments, there remains a need yet in the industry for a collection apparatus or truck for collecting recyclable waste materials which has the ability to receive separated waste materials and to maintain the separated waste materials separately, which has the ability to pack the separated materials efficiently and effectively, which is mechanically simple in its construction and operation, which maintains a good separation of the materials during loading thereof, and which minimizes load imbalances due to the different densities of different recyclable waste materials. Accordingly, it is to the provision of such an apparatus that the present invention is primarily directed.

SUMMARY OF THE INVENTION

Briefly described, in a first preferred form the present invention comprises an apparatus for collecting recyclable waste materials. The apparatus includes a vehicle having a frame and a bed mounted on the frame, with the bed having a front, a rear, a top, and a bottom. A fixed wall extends vertically from the bed bottom toward the bed top and extends longitudinally from the bed rear toward the bed front. A movable wall cooperates with the fixed wall for dividing the bed into side-by-side compartments extending longitudinally.

Preferably, the apparatus further comprises a discharge mechanism for forcing the waste materials in the compartments toward the rear of the bed and the movable wall is attached to (or formed with) the discharge mechanism. Also preferably, the discharge mechanism comprises a unitary or single compactor blade, portions of which are positioned in each of the side-by-side compartments. Also preferably, the side-by-side compartments each have a rear outlet opening adjacent the rear of the bed and a movable door is provided for alternately covering one or the other, but not both, of the rear outlet openings at any one time. In cooperation with an exterior clamshell-style rear cover, a portion of the more dense recyclable waste material can be forced out of the open rear outlet of that compartment and forced behind the movable door to somewhat even out the load in the truck.

In another preferred form, the present invention comprises an apparatus for collecting recyclable waste materials, including a vehicle having a frame and a bed mounted to the frame. The bed has a front, a rear, a top, and a bottom. A movable discharge mechanism for forcing waste material in the bed toward the rear of the bed is provided. The invention further includes a movable wall extending vertically between the bed bottom and the bed top and extending longitudinally from the bed front toward the bed rear. The movable wall at least partly defines side-by-side compartments which extend longitudinally in the bed. Furthermore, the movable wall is secured to the movable discharge means for movement together.

Apparatus according to the invention has several important advantages. Firstly, the apparatus is able to receive separated waste material and to maintain it separated as it is received and stored within the apparatus. The apparatus also is mechanically quite simple, providing good reliability and ease of operation. This elegant design allows a single compactor mechanism to pack more than one compartment, reducing the cost and increasing reliability. Also, some of the more dense material can be packed around and behind the compartment containing less dense material, thereby tending to minimize the otherwise uneven side-to-side distribution of load on the vehicle axles.

Accordingly, it is an object of the present invention to provide a refuse collection apparatus which is effective for receiving and maintaining separated recyclable waste materials.

It is another object of the present invention to provide a refuse collection vehicle which is easily operated and is well-suited for residential collection.

It is another object of the present invention to provide a refuse collection vehicle which is simple in its construction, rugged in operation, and durable.

It is another object of the present invention to provide a refuse collection vehicle which is economical in manufacture and operation.

These and other objects, features, and advantages of the present invention will become apparent upon reading the following specification in conjunction with the accompanying drawing figures.

BRIEF DESCRIPTION OF THE DRAWING FIGURES

DETAILED DESCRIPTION OF THE PREFERRED EMBODIMENT

Figures 1, 2:
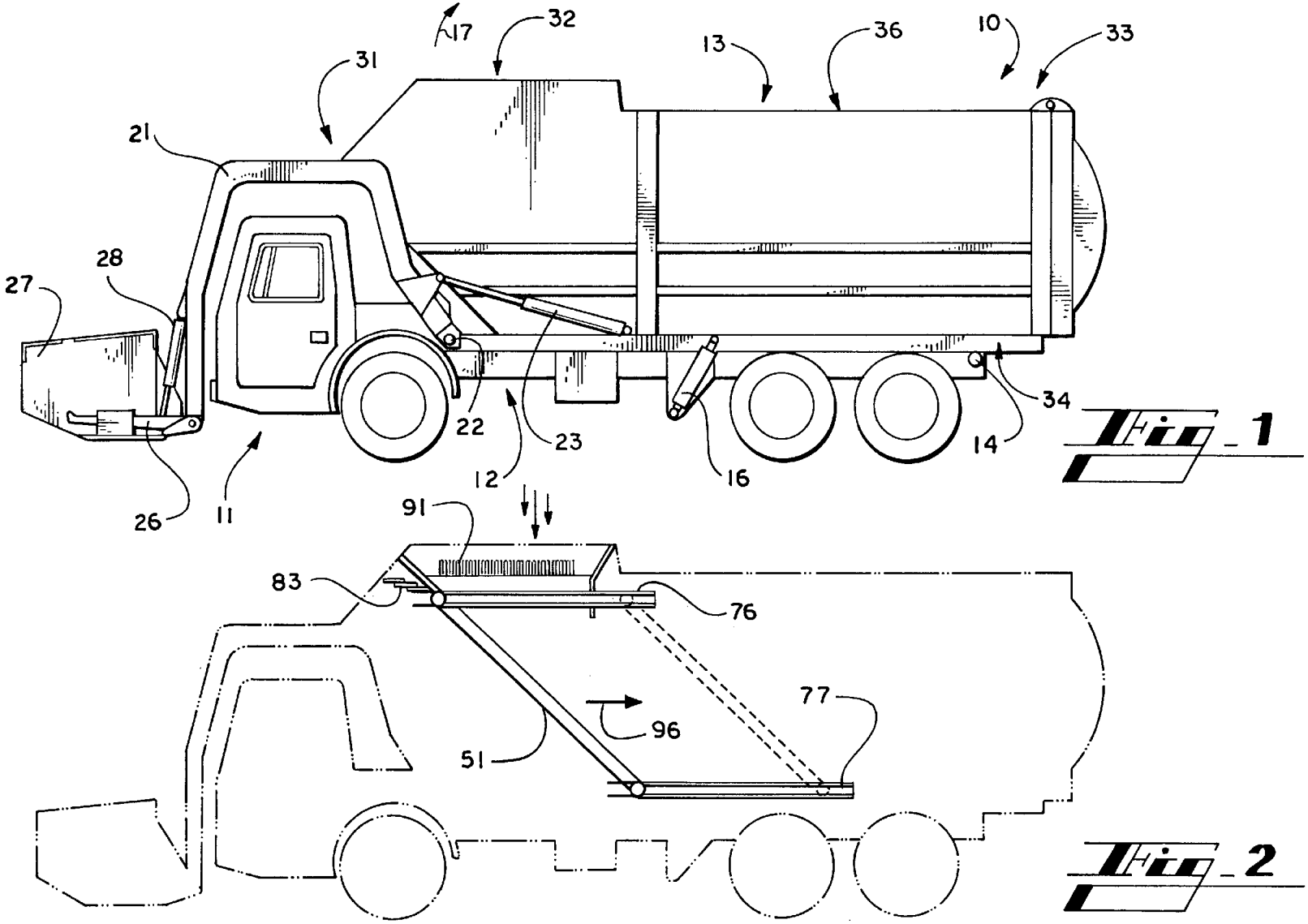
FIG. 1 is a schematic, side elevation view of a segmented residential front loading refuse collection vehicle according to a preferred form of the present invention.
FIG. 2 is a schematic illustration of a portion of the vehicle of FIG. 1.

Referring now to the drawing figures, wherein like reference numerals represent like parts throughout the several views, FIG. 1 shows an apparatus 10 for collecting recyclable waste materials. The apparatus or vehicle 10 includes a truck body 11 mounted on a truck frame 12. Such a body and frame are of typical, commercial construction and are widely available from various manufacturers. A pivoting bed 13 is mounted on the frame for pivotal movement about a large pivot pin 14. With the use of a hydraulic cylinder 16 and suitable controls (unshown) the pivoting bed 13 can be tilted upwardly in the direction of direction arrow 17 to dump collected waste materials out of the rear of the bed as will be described more fully later.

The apparatus or vehicle 10 also includes a pair of movable lift arms or hoist arms, such as lift arm 21. The use of a pair of movable lift arms at the front of a vehicle is well-known in connection with commercial front loading collection vehicles. The second lift arm, in addition to the lift arm 21 depicted in FIG. 1, is a mirror image of the lift arm 21. Because the viewing perspective of FIG. 1 is from the side, the other lift arm cannot be seen in this view.

The lift arms, such as lift arm 21, are pivotally mounted to the frame 12 at a large pivot pin, such as pivot pin 22. The lift arm is movable by a hydraulic cylinder 23 and suitable controls (unshown) between a lowered position depicted in FIG. 1 and a raised position for dumping waste materials into the bed of the truck.

At the ends of lift arms 21 a pair of forks, such as fork 26, are attached. The forks are adapted to be inserted into slots or openings in the sides of trash containers, such as trash container 27. The horizontal attitude of the forks, and correspondingly of the trash container 27, is maintained by a hydraulic cylinder 28 under human control or suitable automatic control during the raising of the container overhead for dumping.

The bed 13 has a forward-most portion 31, a forward top portion 32, a rear-most portion 33, a bottom 34, and a top 36. The bed 13 also includes left and right sides 37 and 38. These features of the front, rear, bottom, top and sides can be understood further by referring to FIGS. 3, 4, and 6.

Figure 4:
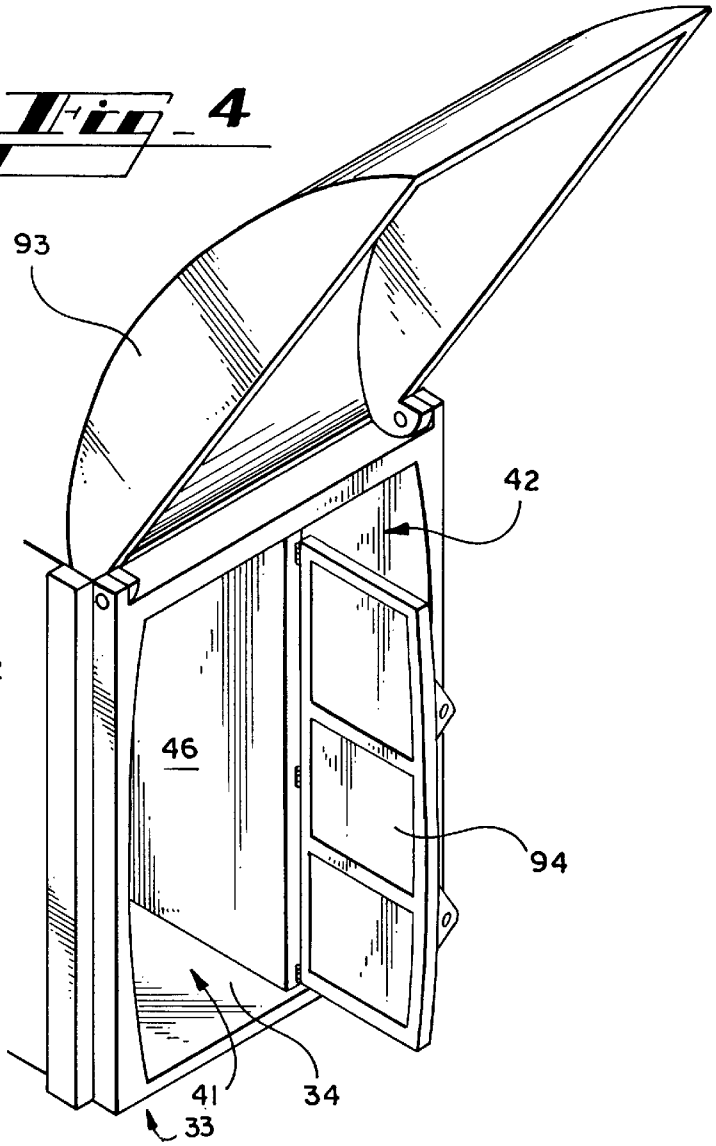
FIG. 4 is a perspective illustration of a rear portion of the vehicle of FIG. 1.
Figure 3:
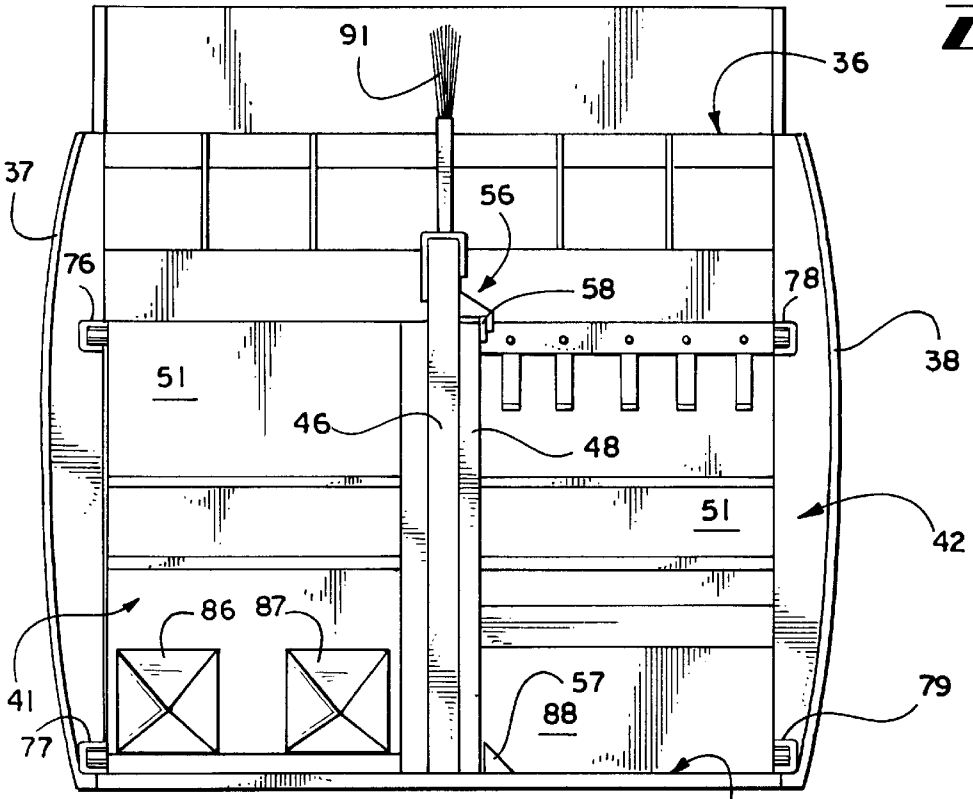
FIG. 3 is a rear, schematic illustration of an interior portion of the vehicle of FIG. 1.
Figure 5:
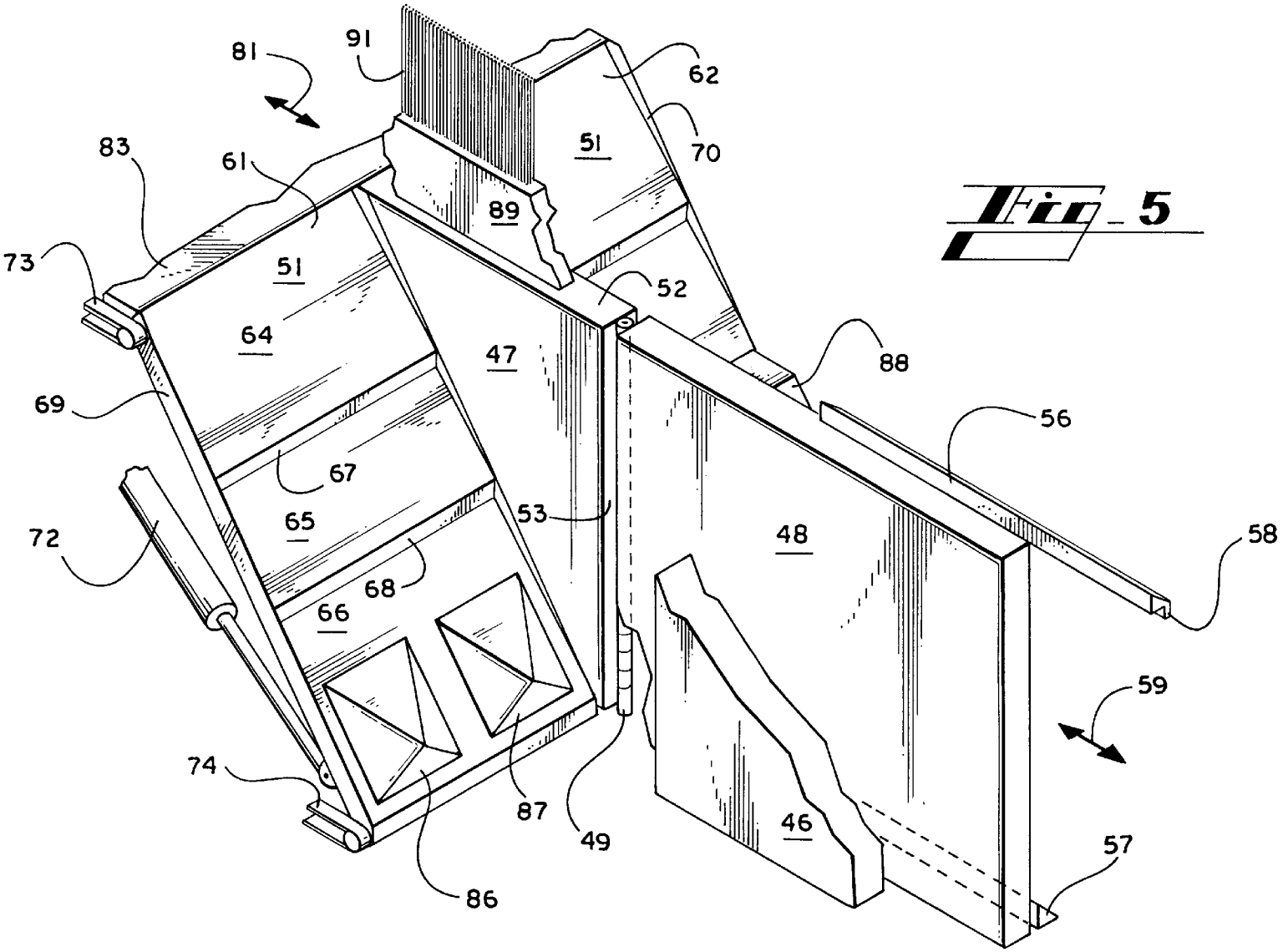
FIG. 5 is a perspective illustration of a divider and compactor arrangement portion of the vehicle of FIG. 1.
Figure 6:
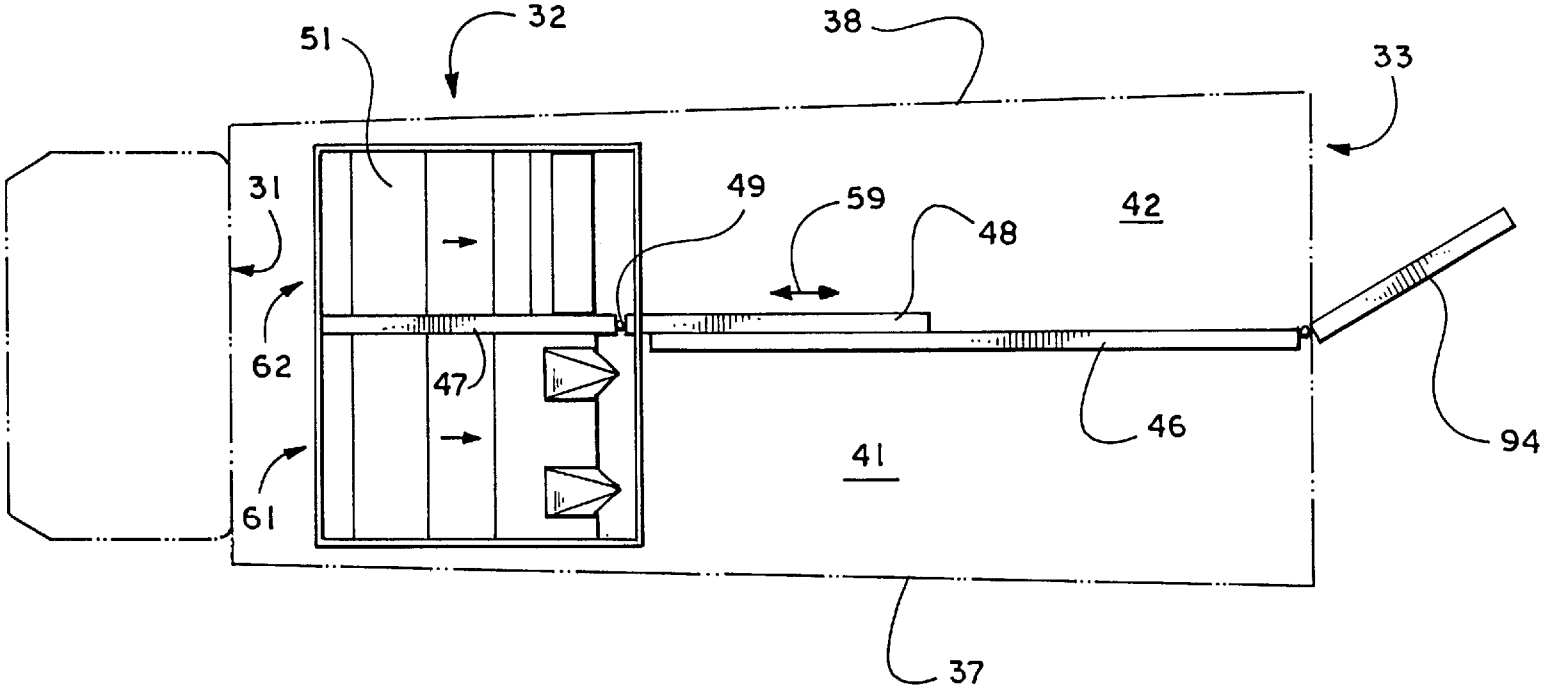
FIG. 6 is a schematic, top view of the vehicle of FIG. 1, with some elements removed for illustration purposes.

Referring now specifically to FIG. 3–6, and particularly FIG. 6, it can be seen that the bed 13 is segmented or divided into left and right compartments 41 and 42. To divide the left compartment 41 from the right compartment 42, three partitions are provided, namely a fixed partition 46, a movable partition 47, and a second movable partition 48. Again referring to FIG. 6, one can see that the two movable partitions 47 and 48 are pivotally mounted to one another by a pivot pin or hinge 49. As best seen in FIGS. 3 and 4, the fixed partition 46 extends from the bottom or floor 34 of the bed 13 toward the top 36 of the bed. Also, as seen in FIG. 4 and FIG. 6, the fixed partition 46 extends from the rear 33 of the bed toward the front 31 thereof, but does not extend quite all the way to the front 31. On the other hand, the second movable partition 48 and the first movable partition 47 extend from adjacent the bottom 34 of the bed toward the top 33 thereof.

As best seen in FIGS. 5 and 6, the first movable partition 47 is rigidly secured to (as by welding) a movable compactor blade 51. The movable compactor blade 51 is disposed at an angle (see FIG. 2) within the bed. As a result, the first movable partition has a triangular shape to accommodate the inclined compactor blade 51, while still having a horizontal top 52 and a vertical face 53.

The second movable partition 48 is guided between the fixed partition 46 and upper and lower guide elements 56 and 57. Upper guide 56 is positioned over the top movable partition 48 and is welded to the side of fixed partition 46. A descending portion 58 of upper guide 56 extends downwardly beside an upper edge of the movable partition 48 and constrains the upper portion of the movable partition against lateral movement. Lower guide 57 is welded to the floor 34 in the right side compartment 42 of the bed 13. Together, the fixed partition 46, the upper guide 56, and the lower guide 57 constrain the movable partition 48 to a linear back and forth motion, as indicated by direction arrow 59 in FIG. 6.

As seen in FIGS. 5 and 6, the movable compactor blade 51 has two portions or sections 61 and 62 which are positioned respectively in the left and right compartments 41 and 42. In actual construction, these left and right sections 61 and 62 are not manufactured as separate elements, but rather a single compactor blade 51 is constructed, to which the first movable partition 47 is welded, thereby creating left and right sections of the compactor blade 51. For strength, the compactor blade 51 is made up of a number of horizontal panels, 64, 65, 66 secured by welding to lateral channel members or stiffeners 67 and 68. Furthermore, the panels and the stiffeners are welded to end rails 69 and 70.

For moving the compactor blade to and fro, a pair of identical hydraulic cylinders, such as hydraulic cylinder 72, are provided. To guide the movement of the compactor blade 51, guides or wear-shoes are provided at the four corners of the compactor blade 51, such as guide shoes 73 and 74 shown on the left side of the compactor blade. Similar guide shoes are secured to the right hand side upper and lower corners of the compactor blade, but are not shown in the illustration for purposes of clarity. The guide shoes ride in upper and lower tracks, such as upper track 76 and lower track 77 (see FIG. 2). As depicted in FIG. 3, in addition to the left hand side upper and lower guide tracks 76 and 77, a right hand side pair of upper and lower guide tracks 78 and 79 are provided in the right hand compartment 42. Collectively, the guide shoes and the guide tracks operate to constrain the movement of the compactor blade 51 and the first movable partition 47 to a linear back and forth motion indicated by direction arrow 81 (see FIG. 5). To accommodate for slight differences between the alignment of the movements of the first movable partition and the second movable partition, the pivot pin 49 allows for pivotal motion of the two movable partitions relative to one another so that movable partition 48 can be moved along its constrained path of movement, while compactor blade 51 with the first movable partition 47 can be moved along its path of movement, while avoiding any binding that might otherwise take place.

As depicted in FIG. 2, the hydraulic cylinder (not depicted in FIG. 2) moves the compactor blade 51 between a retracted position (shown in solid lines in FIG. 2) and an extended position (shown in dash lines in FIG. 2). A telescoping safety floor 83 is attached to the upper edge of the compactor blade 51 and extends forwardly to the forward-most portion 31 of the bed 13. This acts to prevent objects and trash from falling behind the compactor blade and onto the hydraulic mechanism which operates the compactor blade.

The left hand portion of the compactor blade 61 includes a couple of spikes or pointed elements or teeth 86 and 87 which tend to help puncture and more completely compact plastic recyclable materials. In the right hand side compartment 42, the compactor blade includes a lower flat angled face 88 for completely packing or more thoroughly packing paper goods.

Adjacent the forward top portion 32 of the bed 13, a fixed partition 89 extends vertically from above the top face 52 of the movable partition 47 and extends longitudinally generally over the compactor blade when the compactor blade is in the retracted position. The fixed upper partition 89 also includes brushes or bristles 91 pointing upwardly. Together, the bristles and the fixed upper partition act to help separate and maintain separated the recyclable materials as they are dumped from the trash container 27 and into the bed 13. The triangular-shaped movable partition also helps to maintain the separation during dumping.

Referring now to FIG. 4, a clamshell-style rear cover 93 is hingedly mounted to a rear upper end of the bed 13 for movement between a raised position (shown in FIG. 4) and a lowered position or closed position (shown in FIG. 1). As seen in FIG. 4, the left and right compartments 41 and 42 have rear outlet discharge openings formed therein for discharging recyclable waste material out of the bed (the bed is raised to discharge the material by gravity). A flat movable door 94 is hingedly mounted to the fixed partition 46 for movement between a first position covering the rear discharge opening in the left compartment 41 (but leaving the discharge opening for the right hand compartment open or uncovered) and another position covering the outlet opening to the right hand compartment 42 (but leaving uncovered the rear outlet opening for the left hand compartment 41).

This construction is well-suited for receiving separated waste material and maintaining the separated waste material in a separated state as it is received and stored within the truck. It is also mechanically quite simple, providing good reliability and easy operation. The elegant design also reduces costs and increases reliability. In particular, it allows a single compactor mechanism to pack more than one compartment. This type of arrangement is well-suited for residential collection of recyclable waste materials.

In operation, separated recyclable waste materials contained within the container 27 are lifted up by the lift arm 21 and dumped into the upper chute or upper opening of the bed 13, falling generally downwardly as depicted by the downward pointing direction arrows in FIG. 2. Once a good amount of material is collected in the left and right hand compartments, it may become necessary to compact the recyclable material to make more room for receiving additional material. To compact the two compartments, the hydraulic cylinders, such as hydraulic cylinder 72 are operated to drive the compactor blade 51 rearwardly in the direction of direction arrow 96 (see FIG. 2). By operating the vehicle with the movable door 94 covering one or the other of the compartments, heavy (dense) material in the uncovered compartment can be compacted around and behind the movable door to even out the load (weight) of material on the bed. This tends to minimize great differences in the load on the vehicle axle from one side of the axle to the other. In this regard, the clamshell cover 93 defines a space between the rear 33 of the bed 13 and the inside surface of the clamshell cover 93 for receiving this compacted material.

While the invention has been described in a preferred form, it will be apparent to those skilled in the art that additions, deletions, and modifications may be made therein without departing from the spirit and scope of the invention as set forth in the appended claims.

What is claimed:

1. An apparatus for collecting waste materials comprising:

a vehicle having a frame and a bed mounted on said frame, said bed having a front, a rear, a top, and a bottom;

a refuse loading mechanism for loading refuse into said bed of said vehicle;

a fixed wall extending vertically from said bed bottom toward said bed top and extending longitudinally from said bed rear toward said bed front;

reciprocating discharge means for forcing refuse material in said compartments towards said bed rear; and a movable wall cooperating with said fixed wall for dividing said bed into side-by-side compartments extending longitudinally, said movable wall having a first wall portion mounted to said discharge means and a second wall portion pivotally mounted to said first wall portion.

2. An apparatus as claimed in claim 1 wherein said discharge means comprises a unitary blade extending from said bed bottom.

3. An apparatus as claimed in claim 1 wherein said discharge means comprises a first portion and a second portion for discharging material from said compartments, said first and second portions being driven in tandem.

4. An apparatus as claimed in claim 1 wherein said side-by-side compartments comprise first and second compartments each having a rear outlet opening adjacent said rear of said bed, and further comprising a single movable door for alternately covering one or the other of said rear outlet openings.

5. An apparatus as claimed in claim 4 further comprising a hinged rear cover movable between an open position and a closed position, wherein with said hinged rear cover in said closed position a space is defined between said hinged rear cover and said movable door for receiving waste materials from the rear outlet opening not being covered by the movable door.

6. An apparatus as claimed in claim 1 wherein said movable wall is movable between first and second positions and at least partly overlaps said fixed wall in both said first and second positions.

7. An apparatus as claimed in claim 1 wherein said bed has an inlet opening adjacent said front of said bed for receiving waste material and further comprising an inlet divider positioned adjacent said inlet opening for directing separated waste materials into said side-by-side compartments.

8. An apparatus as claimed in claim 7 wherein said inlet divider is positioned above said movable wall and aligned therewith.

9. An apparatus as claimed in claim 1 wherein said movable wall comprises a first panel and a second panel pivotally mounted to said first panel.

10. An apparatus as claimed in claim 1 wherein said bed is pivotally mounted on said frame and further comprising hydraulic means for pivoting said bed.

11. An apparatus for collecting waste materials comprising:

a vehicle having a frame and a bed mounted to said frame, said bed having a front, a rear, a top, and a bottom;

a refuse loading mechanism for loading refuse into said bed of said vehicle;

a movable discharge means for forcing waste material in said bed towards said rear of said bed; and a movable wall extending vertically between said bed bottom and said bed top and extending longitudinally from said bed front towards said bed rear, said movable wall at least partly defining side-by-side compartments extending longitudinally in said bed, and wherein said movable wall has a first portion mounted to said discharge means and a second portion pivotally mounted to said first portion distal said discharge means.

12. An apparatus as claimed in claim 11 further comprising a fixed wall cooperating with and at least partly overlapping said movable wall second portion for defining said side-by-side compartments.

13. An apparatus as claimed in claim 11 wherein said bed has an inlet opening adjacent said front of said bed for receiving waste material and further comprising an inlet divider positioned adjacent said inlet opening for directing separated waste materials into said side-by-side compartments.

14. An apparatus as claimed in claim 13 wherein said inlet divider is positioned above said movable wall and aligned therewith.

15. An apparatus as claimed in claim 11 wherein said side-by-side compartments comprise first and second compartments and each has a rear outlet opening, and further comprising movable cover means for alternately covering one or the other, but not both, of said rear outlet openings.

16. An apparatus as claimed in claim 11 wherein said discharge means comprises a hydraulically driven blade.

* * * * *